US008943707B2

(12) United States Patent
Polegato Moretti

(10) Patent No.: US 8,943,707 B2
(45) Date of Patent: Feb. 3, 2015

(54) WATERPROOF AND VAPOR-PERMEABLE ASSEMBLY INSOLE AND SHOE MANUFACTURED WITH SUCH INSOLE

(75) Inventor: Mario Polegato Moretti, Crocetta del Montello (IT)

(73) Assignee: GEOX S.p.A., Montebelluna (IT)

( * ) Notice: Subject to any disclaimer, the term of this patent is extended or adjusted under 35 U.S.C. 154(b) by 685 days.

(21) Appl. No.: 12/532,679

(22) PCT Filed: Mar. 17, 2008

(86) PCT No.: PCT/EP2008/053151

§ 371 (c)(1),
(2), (4) Date: Nov. 17, 2009

(87) PCT Pub. No.: WO2008/116772

PCT Pub. Date: Oct. 2, 2008

(65) Prior Publication Data

US 2010/0050480 A1 Mar. 4, 2010

(30) Foreign Application Priority Data

Mar. 23, 2007 (IT) ..... PD2007A0106

(51) Int. Cl.
*A43B 7/12* (2006.01)
*A43B 9/02* (2006.01)

(52) U.S. Cl.
CPC .. *A43B 7/125* (2013.01); *A43B 9/02* (2013.01)
USPC ..... 36/3 R; 36/3 B; 36/12

(58) Field of Classification Search
CPC ..... A43B 7/12; A43B 7/06; A43B 7/08; A43B 7/087; A43B 7/125; A43B 13/12; A43B 13/38; A43B 13/386; A43B 17/00; A43B 17/006
USPC ..... 36/3 R, 3 A, 3 B, 55, 45, 12
See application file for complete search history.

(56) References Cited

U.S. PATENT DOCUMENTS 5,285,546 A * 2/1994 Haimerl ..... 12/142 E
5,685,091 A * 11/1997 Yalamanchili ..... 36/55

(Continued)

FOREIGN PATENT DOCUMENTS

CN 1668221 A 9/2005
CN 1910033 A 2/2007

(Continued)

OTHER PUBLICATIONS

English translation of the Chinese Office Action issued Sep. 10, 2010, in Patent Application No. 200880009270.1.

(Continued)

*Primary Examiner* — Marie Bays
(74) *Attorney, Agent, or Firm* — Oblon, Spivak, McClelland, Maier & Neustadt, L.L.P.

(57) ABSTRACT

An assembly insole impermeable to water and permeable to water vapor, with a structure including a membrane impermeable to water and permeable to water vapor and arranged in an upward region, and a supporting layer arranged below the membrane, made of a material resistant to hydrolysis and vapor-permeable or diffusely perforated, and capable of acting as a support for the foot, as a manufacturing base for the shoe, as an element for protecting the membrane against the penetration of blunt objects, and of withstanding the stresses induced in the shoe during use. The membrane and the supporting layer are mutually joined so as to make, as a whole, the assembly insole impermeable to the passage of water and not compromise the vapor permeability of the membrane.

16 Claims, 8 Drawing Sheets

(56) References Cited

U.S. PATENT DOCUMENTS

| | | | | |
|---|---|---|---|---|
| 5,689,903 | A * | 11/1997 | Aumann | 36/77 R |
| 5,711,093 | A * | 1/1998 | Aumann | 36/77 R |
| 5,737,857 | A * | 4/1998 | Aumann | 36/77 R |
| 6,823,609 | B2 * | 11/2004 | Moretti | 36/30 R |
| 7,127,833 | B2 * | 10/2006 | Haimerl | 36/14 |
| 7,370,382 | B2 * | 5/2008 | Polegato Moretti | 12/142 T |
| 7,823,297 | B2 * | 11/2010 | Polegato Moretti | 36/3 R |
| 8,245,416 | B2 * | 8/2012 | Polegato Moretti | 36/14 |
| 2002/0040537 | A1 * | 4/2002 | Polegato Moretti | 36/14 |
| 2002/0157278 | A1 * | 10/2002 | Moretti | 36/3 R |
| 2005/0138845 | A1 * | 6/2005 | Haimerl | 36/55 |
| 2005/0241082 | A1 * | 11/2005 | Moretti | 12/142 V |
| 2006/0162183 | A1 | 7/2006 | Polegato Moretti | |
| 2007/0113359 | A1 * | 5/2007 | Polegato Moretti | 12/142 V |
| 2007/0271815 | A1 * | 11/2007 | Moretti et al. | 36/3 B |

FOREIGN PATENT DOCUMENTS

| | | | |
|---|---|---|---|
| CN | 1925764 | A | 3/2007 |
| EP | 0 713 658 | | 5/1995 |
| JP | 6-222603 | | 8/1994 |
| JP | 10-506029 | A | 6/1998 |
| JP | 11-513582 | | 11/1999 |
| JP | 2002-172003 | | 6/2002 |
| JP | 2003-506176 | A | 4/2003 |
| WO | WO 96/08177 | A1 | 3/1996 |
| WO | WO 2004/004505 | A1 | 1/2004 |
| WO | 2004 028284 | | 4/2004 |
| WO | 2005 063069 | | 7/2005 |
| WO | WO 2005/070658 | A2 | 8/2005 |
| WO | 2008 003375 | | 1/2008 |

OTHER PUBLICATIONS

Office Action issued Dec. 18, 2012 in Japanese Application No. 2009-554014 (w/English translation).

Chinese Office Action Issued Aug. 20, 2012 in Patent Application No. 200880009270.1 (English translation only).

* cited by examiner

WATERPROOF AND VAPOR-PERMEABLE ASSEMBLY INSOLE AND SHOE MANUFACTURED WITH SUCH INSOLE

TECHNICAL FIELD

The present invention relates to a waterproof and vapor-permeable assembly insole.

BACKGROUND ART

The invention also relates to a shoe manufactured with the assembly insole.

The shoe that uses the new insole can adapt, better than others, to being configured for activities which do not require a particular shock-absorbing effect.

According to known shoe manufacturing techniques, the assembly insole is used as a supporting element onto which the upper is assembled before applying the sole, substantially in order to close the "sack" designed to three-dimensionally wrap around the foot.

The assembly insole is a separate component with respect to the others that compose the shoe and utilizes clearly distinct principles and technology with respect to the others.

Therefore, from the constructive standpoint the shoe can be composed of two intermediate components: a sack-like one, which comprises the upper and the assembly insole, and one, the sole, which is applied below the sack.

Only in so-called "tubular" construction the sack of the upper is closed by applying the upper portion, known as vamp.

The application of the assembly insole to the upper, in structures which provide for it, is performed by means of adhesives or with stitches or other mixed systems.

In some constructive cases, the assembly insole is not present, since the upper is sewn and/or glued directly to the sole; in this case, the sole acts as an assembly insole.

The assembly insole must not be confused with the insole on which the foot rests, which is known as "hygienic insole" or "footbed" and has no structural function for the manufacture of the shoe.

There is only one case in which the assembly insole coincides with the footbed, and it is when one or more layers are not introduced, after assembly, in the shoe over the assembly insole and therefore under the foot of the user.

In these cases, the assembly insole acts as a footbed, since it is provided so that it is possible to close the upper on the side that is directed toward the sole (the footbed, due to how it is made and due to the materials used, instead can never perform the function of an assembly insole).

The assembly insole can be made of the most disparate materials and structures depending on the use for which the shoe is intended, but in any case must always be able to constitute a support for the upper and many times also for the sole, so that the shoe stays together.

The assembly insole can be reinforced by applying shanks and/or be made more flexible by means of cuts, holes or sections made of softer materials.

In many shoes, not only sports shoes, the sole assumes a merely protective or technical purpose, and therefore the assembly insole is assigned the task of keeping the shoe together and of bearing the weight of the user.

For example in cycling shoes, the sole is designed substantially to allow engagement or contact with the pedal; in soccer shoes, the sole must allow the application of studs, and in golf shoes it must allow to apply spikes.

In some very light shoes, lightweight and thin treads have the only purpose of protecting against wear the material arranged below the shoe, for example the hide of tubular moccasins.

Shoes are known which solve the problem of perspiration by perforating the sole and introducing special membranes which are impermeable to water and permeable to water vapor and allow breathing but prevent the penetration of water and/or moisture or foreign objects into the shoe.

In particular, a structure is known which replaces the central portion of the sole with a membrane which is supported by a protective net and by other layers in order to maximize the vapor-permeable (breathing) surface of the sole.

A similar solution is proposed by another invention which uses a membrane arranged inside the shoe, in the lining or in the assembly insole, with a layer of net or other vapor-permeable material arranged within the sole and capable only of protecting the membrane against blunt objects which might be trodden upon while walking.

These solutions allow to use soles composed of shock-absorbing layers and layers which are wear-resistant and antislip (tread).

DISCLOSURE OF THE INVENTION

The aim of the present invention is to provide an assembly insole which allows to provide a shoe which, while having below the foot insertion region a membrane which is impermeable to water and permeable to water vapor, has minimized the structure of the sole both in terms of surface and optionally in terms of thickness and weight, allowing in any case to utilize in the best possible way the vapor permeability of the membrane.

Within this aim, an object of the present invention is to provide a shoe in which the lower portion is waterproof and vapor-permeable even though the sole contains no protective or waterproofing element, being reduced to the mere functional or shock-absorbing elastomeric materials.

Another object is to simplify considerably the process for manufacturing the sole and the shoe.

Another object is to provide a structure which allows the optional waterproofing of the entire shoe and not only of its lower portion.

Still another object is to enlarge the active area of the membrane until it affects substantially the entire sole of the foot.

This aim and these and other objects, which will become better apparent hereinafter, are achieved by an assembly insole which is impermeable to water and permeable to water vapor, with a structure characterized in that it comprises:

- a membrane which is impermeable to water and permeable to water vapor and is arranged in an upward region;
- a supporting layer which is arranged below the membrane, is made of a material which is resistant to hydrolysis and is vapor-permeable or diffusely perforated, and is capable of acting as a support for the foot, as an assembly base for the shoe, as an element for protecting the membrane against the penetration of blunt objects, and of withstanding the stresses induced in the shoe during use, the membrane and the supporting layer being mutually joined so as to make, as a whole, said assembly insole impermeable to the passage of water and not compromise the vapor permeability of the membrane.

Advantageously, the shoe manufactured with said insole comprises an upper which is assembled to said assembly insole and is coupled, at the peripheral region of said insole, to a sole made of polymeric material which provides a waterproof seal directly on the assembly insole. Said seal is fundamental in preventing the water from rising from the bottom of the shoe and being drawn, for example by the supporting layer, toward the perimetric edges of the membrane and penetrating the shoe by flowing around said edges.

BRIEF DESCRIPTION OF THE DRAWINGS

Further characteristics and advantages of the invention will become better apparent from the description of some preferred but not exclusive embodiments thereof, illustrated by way of non-limiting example in the accompanying drawings, wherein.

It is noted that anything found to be already known during the patenting process is understood not to be claimed and to be the subject of a disclaimer.

WAYS OF CARRYING OUT THE INVENTION

Figure 1:
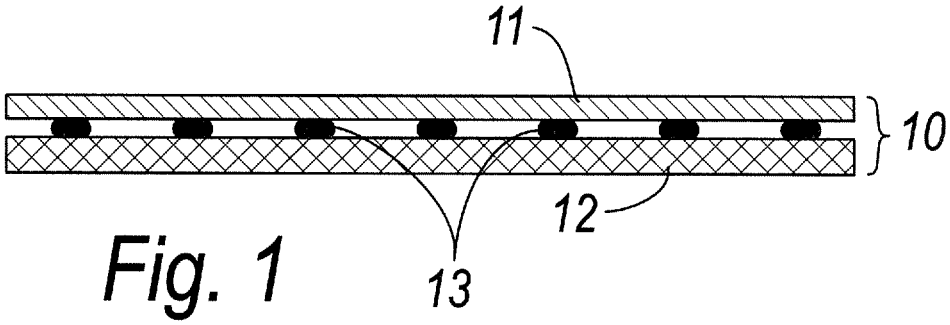
FIG. 1 is a sectional view of an assembly insole according to the invention.
Figure 2:
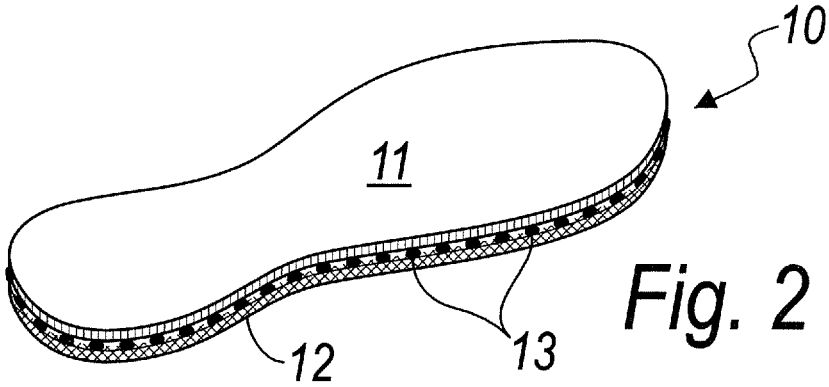
FIG. 2 is a perspective view of the insole of FIG. 1.

With reference to FIGS. 1 and 2, an assembly insole according to the invention is generally designated by the reference numeral 10 and is composed of a membrane 11, which is impermeable to water and permeable to water vapor and is arranged in an upward region, and of a layer 12 for supporting the plantar arch, which is arranged below the membrane 11, is made of a material which is resistant to hydrolysis and is vapor-permeable or diffusely perforated and capable of acting as a support for the foot and as an element for protecting the membrane 11 against the penetration of blunt objects, and of withstanding the stresses induced in the shoe during use.

The assembly insole, and in particular the supporting layer 12, allow to close the sack-upper.

This component of the shoe, the assembly insole 10, generally shaped according to the lower portion of the last, is the structural pivot of shoes, to which the upper, lining, the counter, toe cap, et cetera are attached.

The membrane 11 is of the type of those available commercially and commonly known by the trade-name Gore-Tex®, optionally coupled to an upper mesh made of synthetic material (not shown in the figures).

The layer 12 can be constituted for example by mesh made of synthetic or metallic material, by microstretched metal sheets, by partially compressed synthetic fibers fused by heat, by compressed natural fibers such as hemp or coconut fibers, or by leather.

Such elements are mutually joined so as to make the insole impermeable to the passage of water and not compromise the vapor permeability of the membrane, for example by means of glue spots 13, or by means of a perimetric layer of adhesive material, or by welding at high frequency by melting a perimetric film made of PVC or PU.

There can be reinforcement or structural elements (not shown for the sake of simplicity) such as leather, felt, polymeric materials or synthetic leathers, so long as they are vapor-permeable or perforated in the vapor permeation regions, which are inserted after the assembly of the membrane 11 with the supporting layer 12 or are applied before the assembly of the shoe, with such means as to not compromise vapor permeability, such as for example stitches, spot gluing or gluing only in the perimetric non-vapor permeable areas.

Such an assembly insole 10 is used in the manufacture of shoes the sole of which can have all the technical content required for use, but has large openings or diffuse holes, even of considerable size, so that such sole is not adapted to stiffen the shoe against for example torsion.

The assembly insole described earlier has the necessary rigidity.

Figure 3:
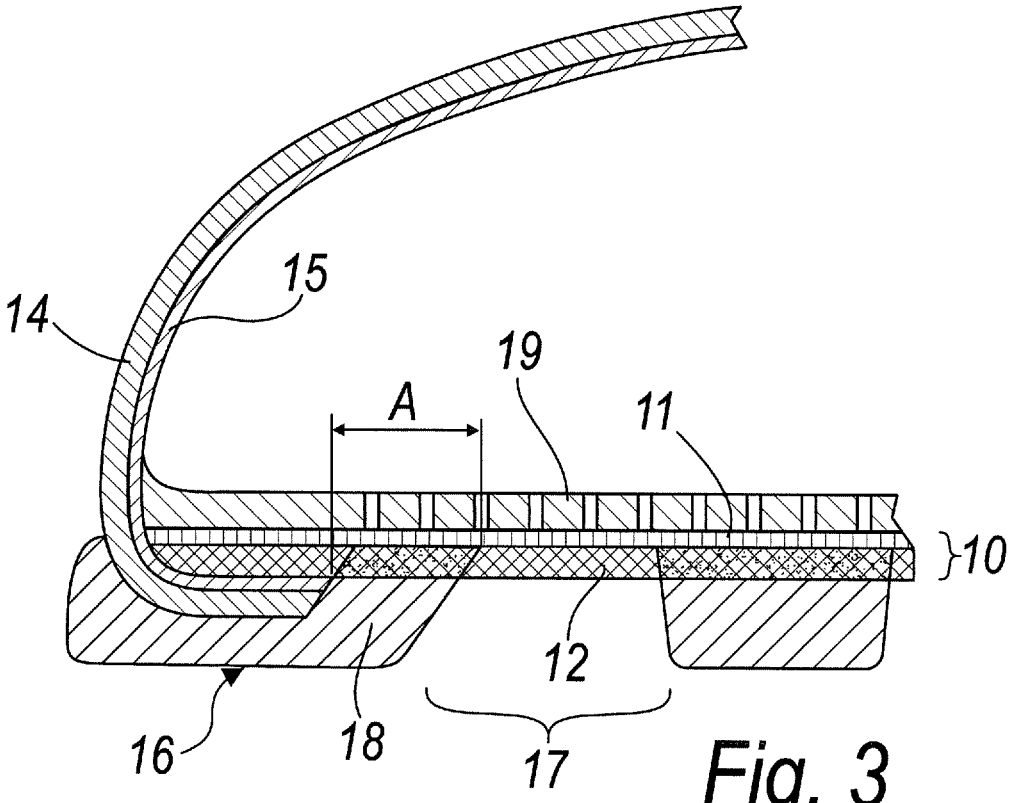
FIG. 3 is a partial sectional view of a first shoe provided with the insole according to the invention.
Figure 4:
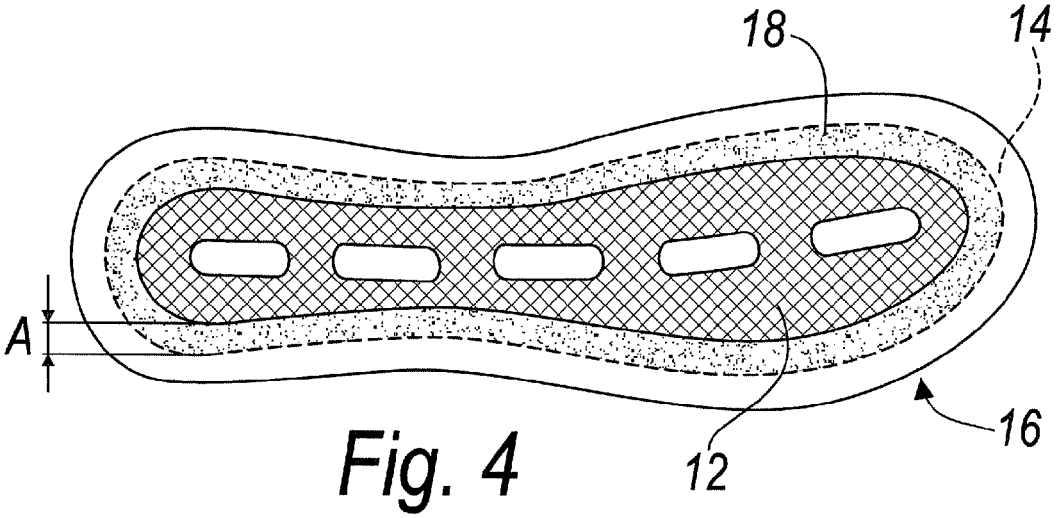
FIG. 4 is a bottom view of the shoe of FIG. 3.

With reference now to FIGS. 3 and 4, a first structure of a vapor-permeable shoe which uses the assembly insole 10 according to the invention is provided according to a manufacturing method commonly known as "classic AGO lasting", in which the lower edges of the upper 14 are folded and glued below the assembly insole 10, which is impermeable to water and permeable to water vapor.

The upper 14 is sewn and prepared beforehand with respect to the shoe assembly operation. During assembly, a last which has the shape and dimensions of the foot is used to give the selected three-dimensional shape to the upper 14.

The insole 10 (of which the presence of the glue spots 13 is omitted for the sake of simplicity from now onward) is attached temporarily below the upper supporting last (not shown) and the upper 14, with or without the lining 15 (for example depending on whether the shoe is for cold or hot seasons) is glued perimetrically, without using nails or staples which might damage the membrane 11 of the assembly insole 10, so as to make it adhere to the insole 10 (an operation known as lasting).

A sole 16 is then applied which has large openings 17 or holes which allow maximum vapor permeation in so far as allowed by the use for which the shoe is intended.

The portions 18 of the sole 16, which are perimetric but not in contact with the edges of the upper 14 (i.e., the ones that define the outer edges of the openings 17), must penetrate through the layer 12, so as to create an area A for perimetric seal with the membrane 11.

Such sealing area can be provided for example by means of the direct injection into a mold of the sole 16, which by being performed with a material which is in the liquid or highly fluid state at the time of injection, penetrates through the layer 12 and engages the membrane 11, sealing it (in FIG. 3, the overlapping of the sole 16 on the layer 12 is visible at the area A).

The portions of the insole 10 that are not covered by the sole 16 remain vapor-permeable, but water cannot enter the shoe thanks to the perimetric seal and the waterproofing of the insole 10.

A vapor-permeable or perforated footbed 19 can be arranged above the assembly insole 10 so as to complete the shoe.

As an alternative (FIG. 5), it is possible to apply by gluing a pre-molded sole 16*a*.

In this case, one must ensure that the glue 18*a* passes beyond the layer 12, for example if it is constituted by a net, through its meshes, so as to engage and seal in the area A the membrane 11.

For this purpose, it is possible to use special hot-melt or silicone glues in order to provide a presealed area onto which the sole is to be attached.

The upper and the lining are now designated by the reference numerals 14*a* and 15*a*.

In an alternative, which is not shown, it is possible to use a film of adhesive made of PVC (polyvinylchloride) or PU (polyurethane) perimetrically between the insole 10 and the sole 16, in order to provide high-frequency welding by melting of the film and join the components into a monolithic unit.

Another alternative solution (FIG. 6) consists in pre-injecting a sealing layer 20 onto which the sole, now designated by the reference numeral 16*b*, is then applied.

The upper and the lining are now designated by the reference numerals 14*b* and 15*b*.

In order to provide a sufficient sealing area while reducing the size of the sole, now designated by the reference numeral 16*c*, it is conceivable (FIG. 7) to extend the sealing regions, now designated by the reference sign A1, by also perforating the lasting margins of the upper 14*c*, i.e., the edges 21 that are folded below the insole, with the holes 22, and of the optional lining 15*c*, with the holes 23, or by providing the lower edges of such elements, the upper 14*c* and the optional lining 15*c*, with materials which allow the glue or the liquid sole to penetrate until it engages the membrane 11 of the assembly insole 10, passing through the layer 12.

If (FIG. 8) the layer 12 does not allow the sealing material to pass to the membrane 11, such layer must be modified so as to make it sealable, for example by piercing it or replacing its edges, in the sealing regions, with waterproof material (waterproof edge 24).

As an alternative (FIG. 9), the entire shoe can be provided so that it is waterproof by using an upper 14*d* made of completely waterproof material which is welded directly to the membrane 11 of the assembly insole 10, which is waterproof and vapor-permeable and thus constitutes the seal against water.

The sole 16*d*, for example, can engage the upper 14*d* and therefore not be decisive for the waterproof seal.

Figure 10:
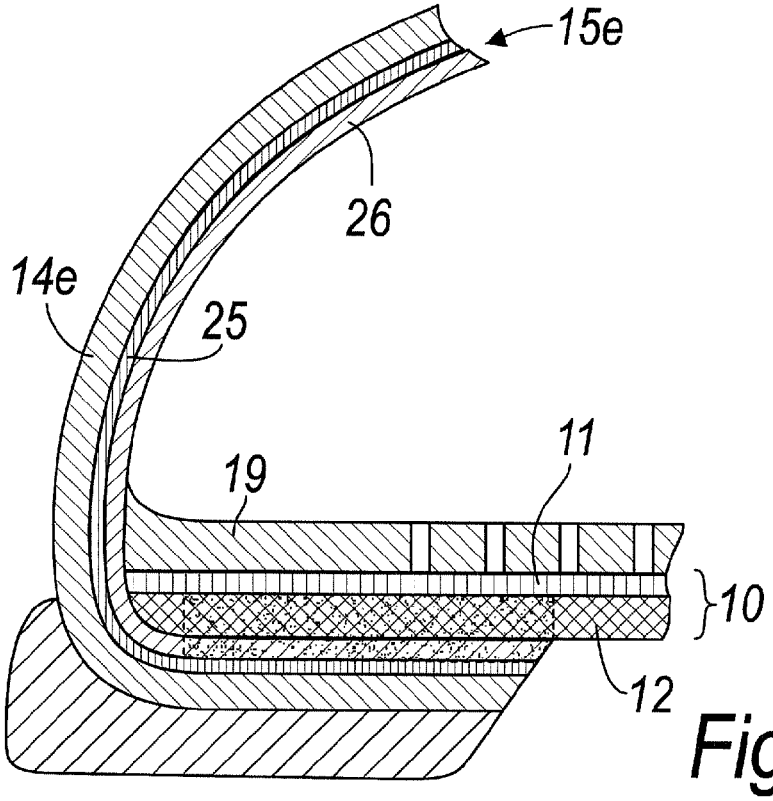

As a further alternative (FIGS. 10-12), the entire shoe can be provided so that it is impermeable to water, with the upper 14*e* made of a material which is not waterproof and with a waterproof lining 15*e* which is constituted by an outer membrane 25 which is waterproof and vapor-permeable and is lined with non-waterproof material 26 designed for contact with the foot (for example, Vellutina fabric, cotton, wool, et cetera).

In this case it is possible to provide three alternative possibilities:

A) waterproofing, for example by high-frequency welds or by spreading adhesives or polyurethane or silicone sealants (FIG. 10), the lining material 26 along the lower edges designed to adhere to the insole 10, so that the gluing provides a seal B) passing the glue or material of the sole 16*e* (FIG. 11), if injected in the liquid state, through the upper 14*e*, with edges 27 made of perforated materials (for example nets, et cetera) and through the layer 12 (as in FIG. 3) or with appropriately provided perforations so as to be sealed onto the membrane 11.

C) applying a perimetric sealing band 28 (FIG. 12), which acts as a bridge between the membrane 25 of the lining 15*e* and the membrane 11 of the insole 10 (the upper is again designated by the reference numeral 14*e* and the sole by the reference numeral 16*e*).

Figure 13:
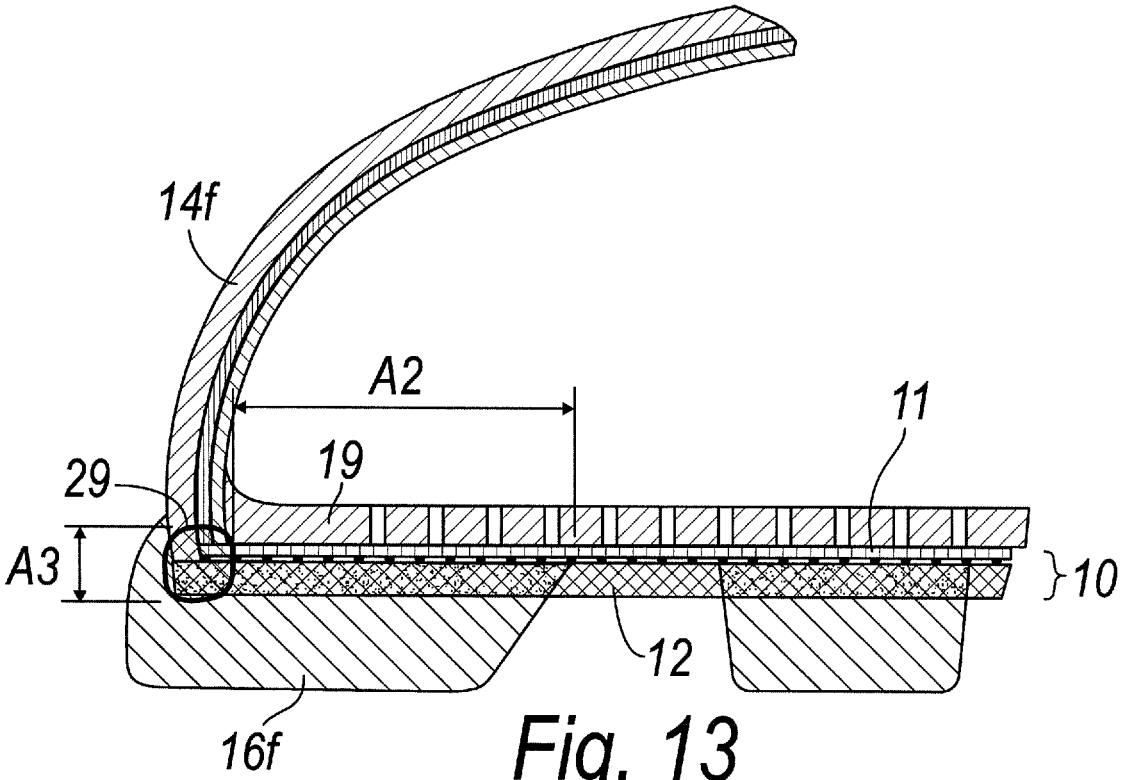
Figure 13A:
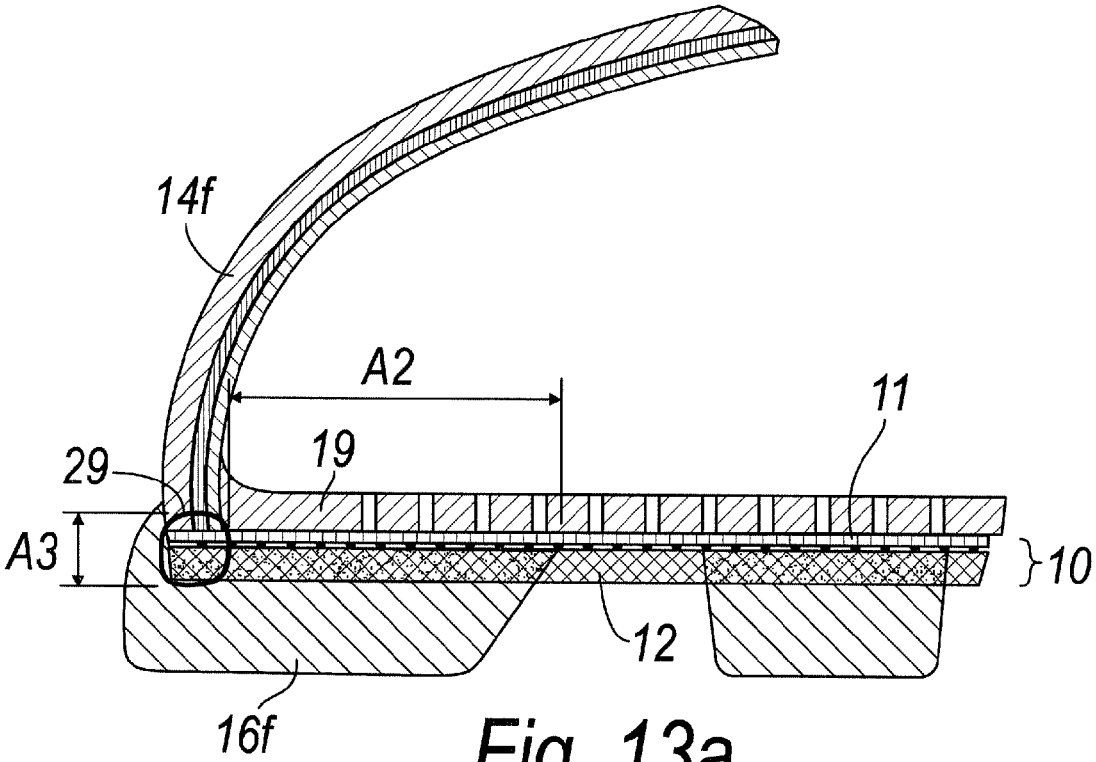

In another alternative embodiment of the shoe, shown in FIGS. 13, 13*a*, the waterproof and vapor-permeable insole 10, in which the membrane 11 is comprised, is joined by means of stitches 29 to the edges of the upper 14*f*, according to the manufacturing method commonly known as Strobel.

As an alternative, it is possible to use other types of manufacturing methods with a sewn insole, known as Goodyear, Ideal, et cetera.

These types of manufacturing methods differ from the preceding one in the lack of overlap between the upper and the insole, which are instead joined by the stitches 29.

This simplifies the possibility of providing a seal between the sole 16*f* and the membrane 11 of the insole 10 (and the membrane of the upper/lining in the case of fully waterproof shoes).

The sole 16*f* must penetrate through the layer 12 of the insole 10, so as to create a perimetric seal A2 with the membrane 11 and simultaneously seal in A3 the stitched seam 29 between the upper 14*f* and the insole 10.

This can occur, for example, by direct injection of the sole 16*f*, which by being liquid or very fluid at the time of injection penetrates through the protective material and engages the membrane 11, sealing it.

In this case also, the portions that are not covered by the sole 16*f* remain vapor-permeable, while water cannot enter the shoe, thanks to the insole 10, which is impermeable to water and permeable to water vapor.

Figure 5:
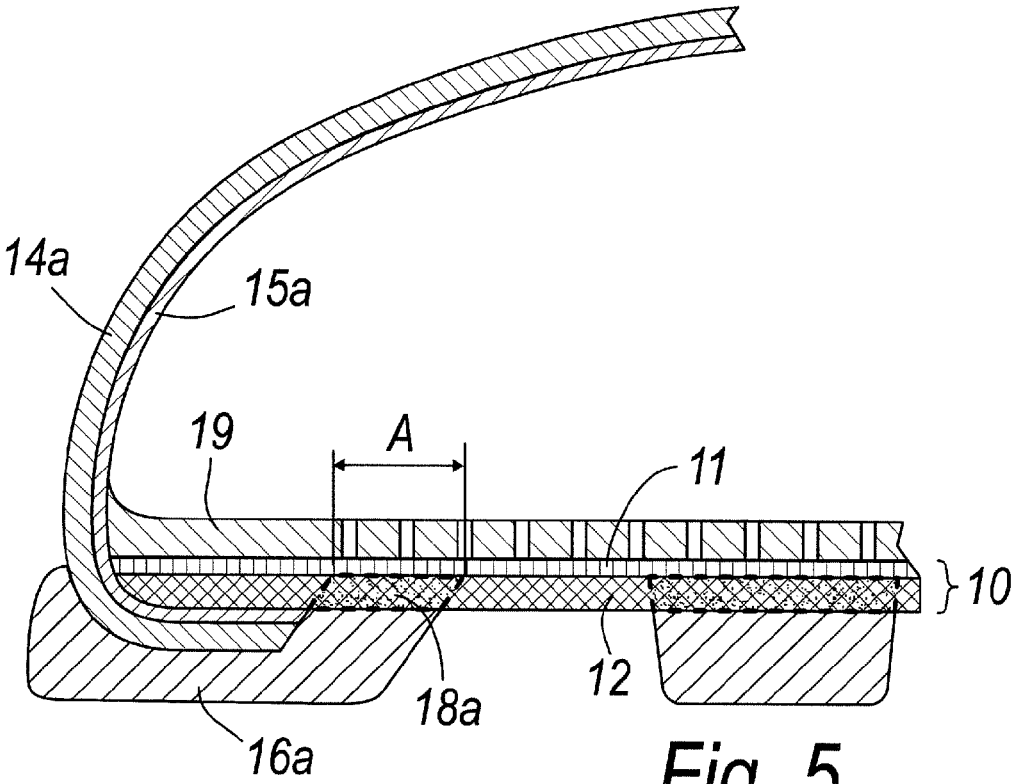
FIGS. 5 to 14*a* are partial sectional views of respective types of shoes provided with the insole according to the invention.
Figure 6:
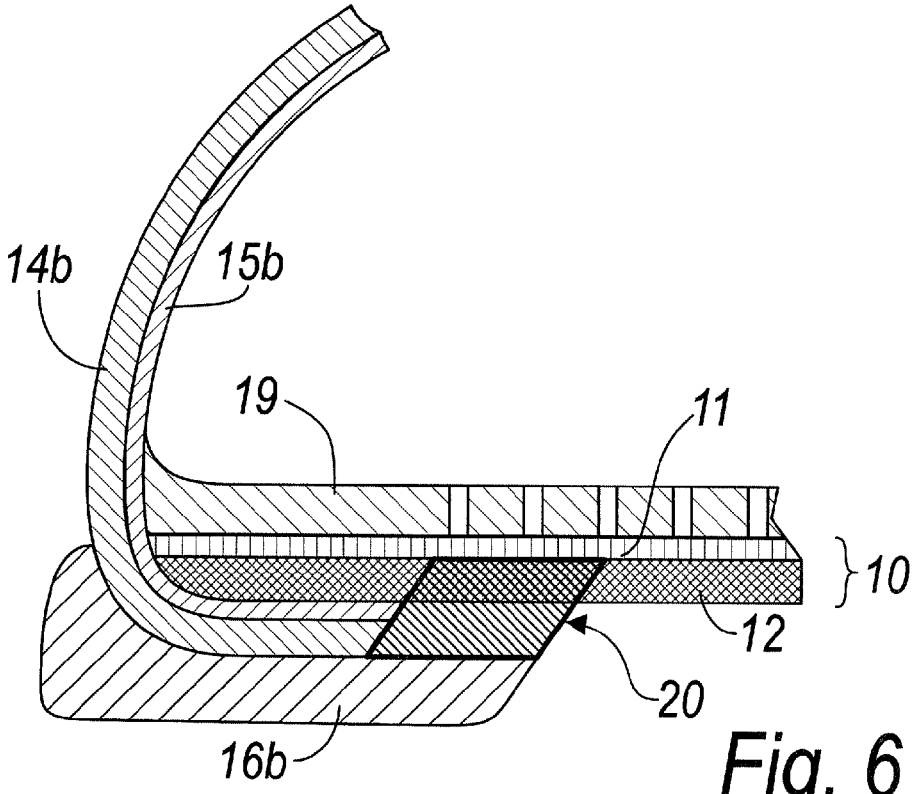

For further details, see the description of FIGS. 5 and 6.

Figure 14:
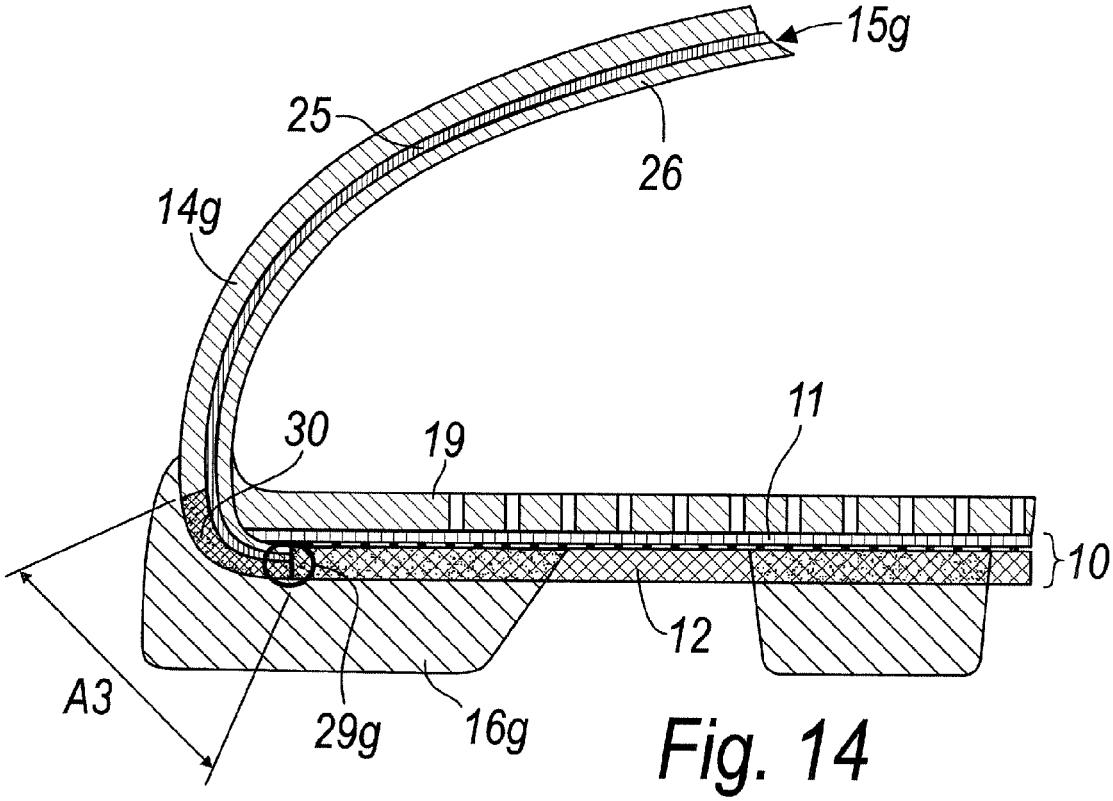
Figure 14A:
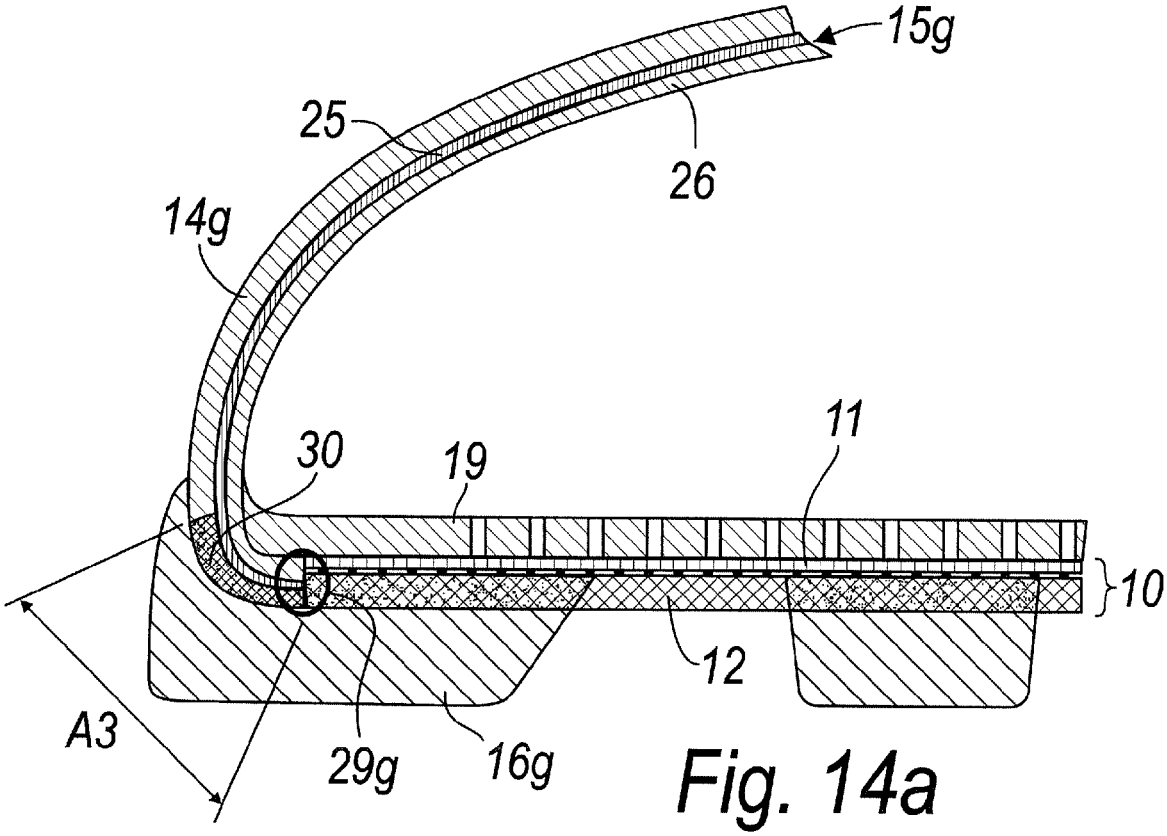

The manufacturing method of FIGS. 14,14*a* differs from the preceding one in the increased sealing area A3 which is provided by the insertion of a net-like band 30 so as to replace the lower edge of the upper, now designated by the reference numeral 14*g* (the sole is designated by the reference numeral 16*g* and the stitched seam is designated by the reference numeral 29*g*).

The fluid material of the sole 16*g* passes through the net-like band 30 of the upper 14*g* and the layer 12 of the insole 10, respectively sealing the membrane 25 that is provided on the lining 15*g*, the membrane 11 that is provided on the insole 10, and the stitched seam 29*g*.

Figure 7:
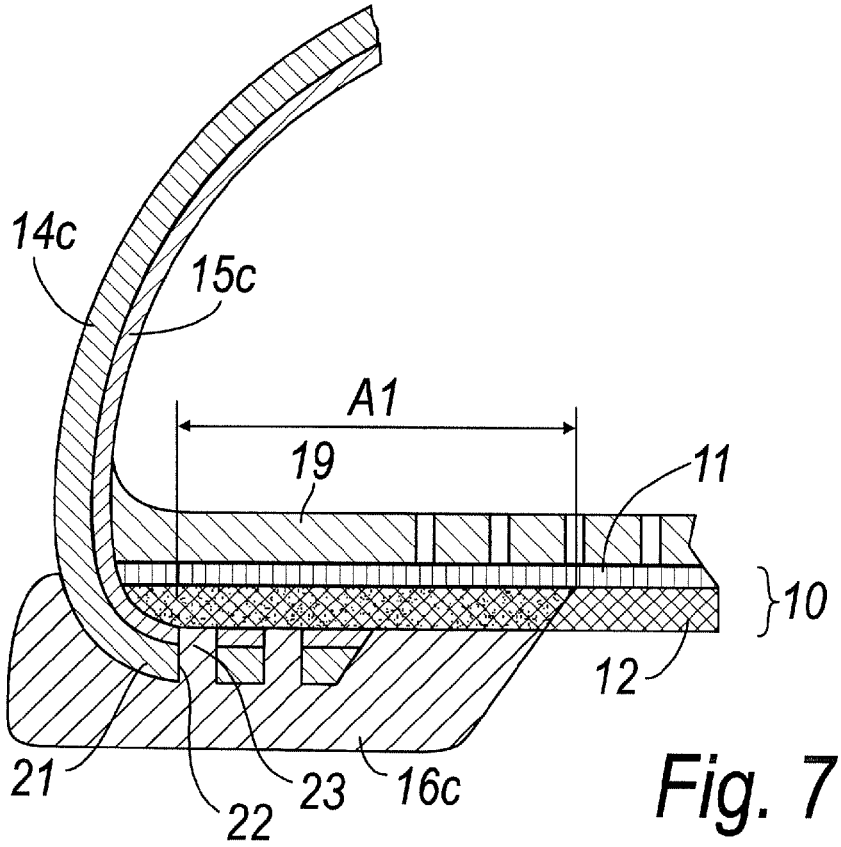
Figure 11:
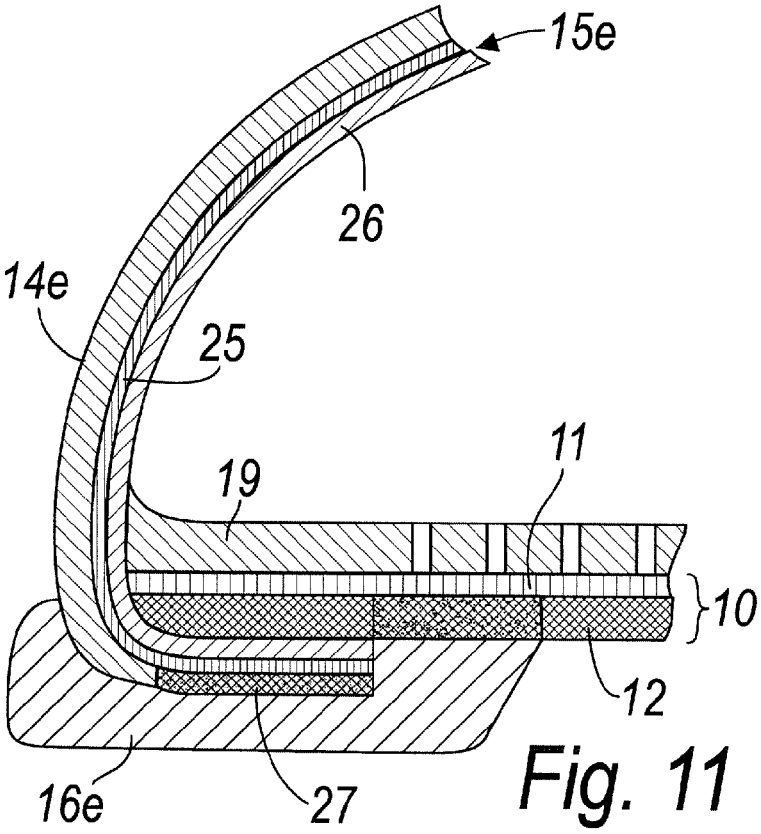

For further details, see the description of FIGS. 7 and 11.

Figure 8:
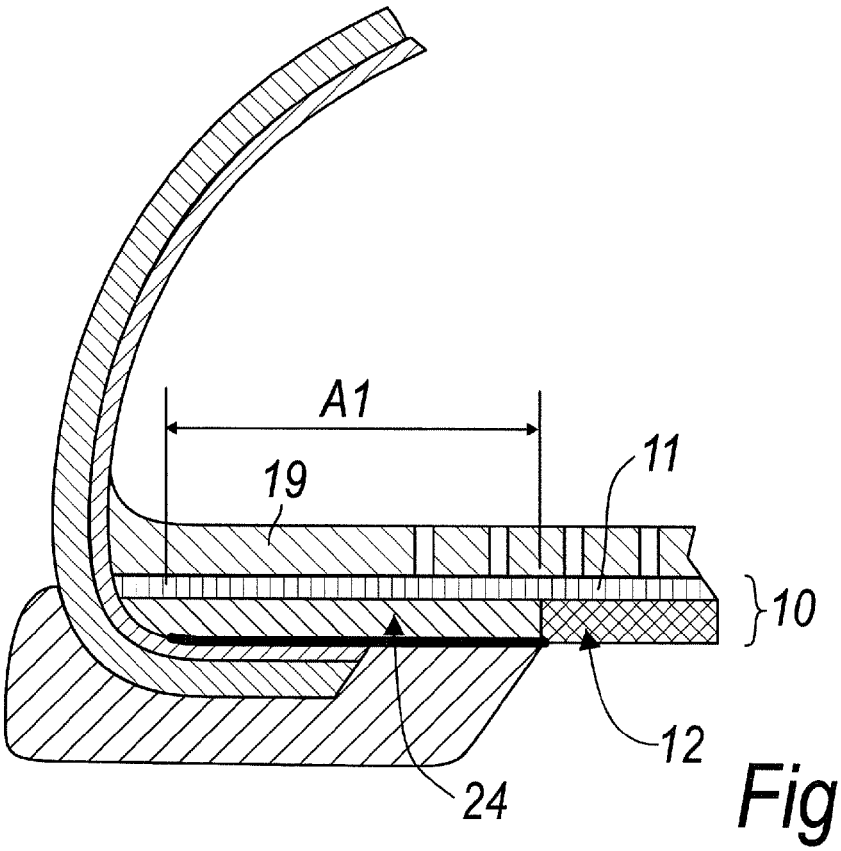
Figure 9:
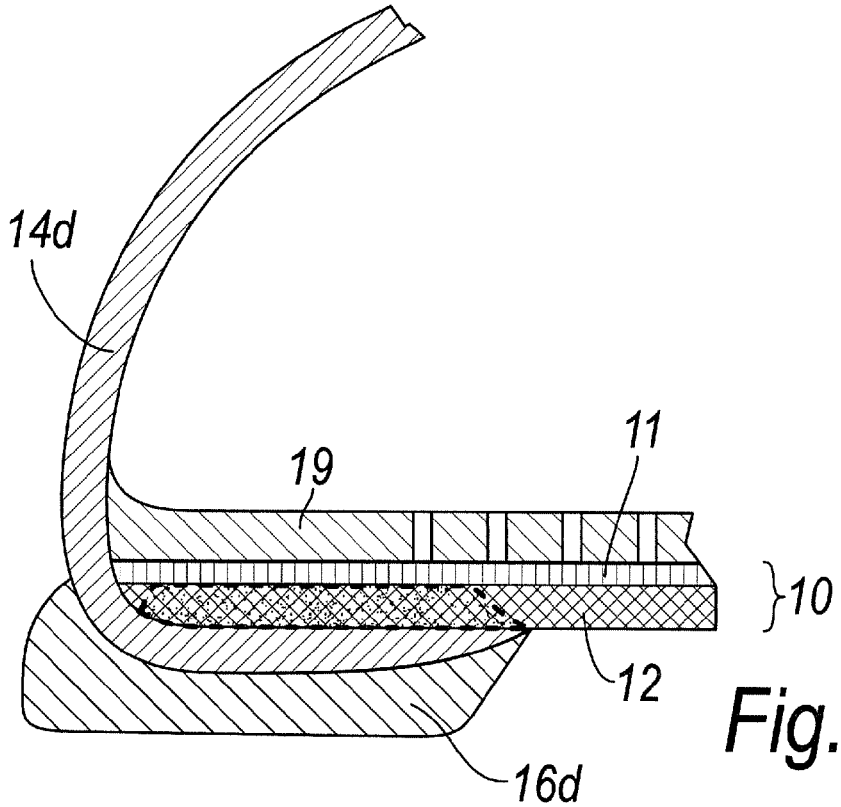
Figure 12:
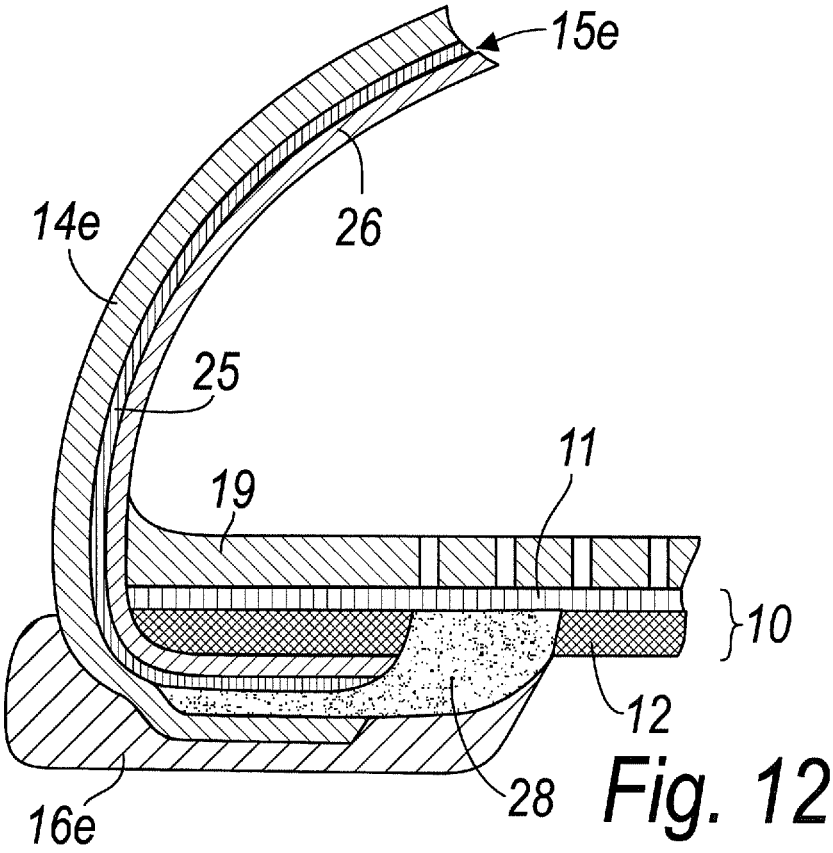

With this type of manufacture, the same cases as in FIGS. 8, 9 and 12 of the preceding embodiment can occur.

In practice it has been found that the invention can be applied easily to all shoes in which the insole must constitute a supporting structure of the shoe or in which maximum flexibility of the shoe is required.

If a particular shock-absorbing effect is also sought which cannot be achieved by the sole due to the lack of much of the tread and of the sole itself along the entire thickness (vapor-permeable open areas), the effect can be achieved by using internal insoles or layers arranged above the assembly insole 10, which are perforated and made of highly shock-absorbing materials, such as for example gels, expanded polyurethanes, or molded air pockets with through holes.

The invention thus conceived is susceptible of numerous modifications and variations, all of which are within the scope of the appended claims; all the details may further be replaced with other technically equivalent elements.

In practice, the materials used, so long as they are compatible with the specific use, as well as the dimensions, may be any according to requirements and to the state of the art.

The disclosures in Italian Patent Application No. PD2007A000106 from which this application claims priority are incorporated herein by reference.

The invention claimed is:

1. A shoe provided with an assembly insole which is impermeable to water and permeable to water vapor, comprising:

a membrane which is impermeable to water and permeable to water vapor and is arranged in an upward region;

a supporting layer which is arranged below the membrane and made of a material which is resistant to hydrolysis and is vapor-permeable or diffusely perforated, and is capable of acting as a support for a foot, as an element for protecting the membrane against penetration of blunt objects, and of withstanding stresses induced in a shoe during use, the supporting layer being configured to close a sack-upper, the sack-upper being a portion of the shoe designed to three-dimensionally wrap around the foot, the membrane and the supporting layer being mutually joined so as to make, as a whole, said assembly insole impermeable to the passage of water and not compromise the vapor permeability of the membrane; and an upper with lower edges folded and glued below the assembly insole and a sole with wide openings or holes such as to allow maximum vapor permeation, the portions of said sole, which are perimetric, but not in contact with said edges of the upper, being penetrated through said layer, providing an area for a perimetric seal with said membrane.

2. The shoe according to claim 1, wherein said membrane is coupled to an upper mesh made of synthetic material.

3. The shoe according to claim 1, wherein said supporting layer is selected among mesh made of synthetic or metallic material, microstretched metal sheets, partially compressed synthetic fibers fused by heating, compressed natural fibers such as hemp or coconut fibers, or leather.

4. The shoe according to claim 1, wherein said membrane and said supporting layer are mutually joined so as to make the insole impermeable to the passage of water and not compromise the vapor permeability of the membrane, selecting among spots of glue, a perimetric layer of adhesive material, or high-frequency welding by melting of a perimetric film made of PVC or PU.

5. The shoe according to claim 1, further comprising reinforcement or structural elements selected among leather, felt, polymeric materials or synthetic leathers, so long as they are vapor-permeable or perforated in the vapor permeation regions, which are inserted after the assembly of the membrane with the supporting layer or applied so as to not compromise vapor permeability, selected among stitches, spot gluing or gluing only in the non-vapor permeable perimetric areas.

6. The shoe according to claim 1, wherein said sealing area is provided by direct injection in a mold of the sole.

7. The shoe according to claim 1, wherein said sealing area is provided by gluing a sole which is pre-molded with adhesive which passes beyond said layer and is engaged so as to seal said membrane, said glue being selected among hot-melt or silicone glues.

8. The shoe according to claim 1, wherein said sealing area is provided by a film of adhesive made of PVC or PU, which is arranged perimetrically between said insole and said sole, to perform a high-frequency welding by melting the film and joining the components into a single unit.

9. The shoe according to claim 1, wherein said sealing area is provided by a sealing layer which is pre-injected and onto which the sole is applied.

10. The shoe according to claim 1, wherein the lower edges of the upper have holes which allow the glue or liquid sole to penetrate until it engages said membrane of said assembly insole, passing through said layer to increase the sealing area.

11. The shoe according to claim 10, wherein the lower edges of said upper and an optional lining are made of materials which allow the adhesive or the liquid sole to penetrate until it engages said membrane of said assembly insole, passing through said layer to increase the sealing area.

12. The shoe according to claim 1, wherein said supporting layer of the insole is sealable, by providing selectively perforations or replacement of the edges, in the sealing areas, with waterproof material.

13. The shoe according to claim 1, wherein the upper is made of fully waterproof material, which is welded directly to said membrane of the waterproof and vapor-permeable assembly insole.

14. The shoe according to claim 1, wherein the upper is made of a material which is not impermeable to water and a lining constituted by a waterproof and vapor-permeable outer membrane which is lined with a material which is not waterproof, to make contact with the foot, which is rendered waterproof selectively by high-frequency welds or by spreading adhesives or polyurethane or silicone or similar sealants and glued hermetically with said layer of said insole.

15. The shoe according to claim 1, wherein the upper is made of a material which is not impermeable to water and a lining which is constituted by a waterproof and vapor-permeable outer membrane which is lined with a material which is not waterproof, to make contact with the foot, said upper having lower edges provided by perforated materials which allow the glue or the material of the sole, if injected in the liquid state, to pass through them.

16. The shoe according to claim 1, wherein the upper is made of a material which is not impermeable to water and a lining which is constituted by a waterproof and vapor-permeable outer membrane which is lined with a material which is not waterproof, to make contact with the foot, a band for providing a perimetric seal being applied which constitutes a bridge between said membrane of the lining and the membrane of said insole.

* * * * *